US006896153B1

(12) United States Patent
Yencheng

(10) Patent No.: US 6,896,153 B1
(45) Date of Patent: May 24, 2005

(54) MODELED CREAM BOTTLE

(76) Inventor: Chin Yeh Yencheng, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/782,906

(22) Filed: Feb. 23, 2004

(51) Int. Cl.[7] ..... B67D 5/42
(52) U.S. Cl. ..... 222/78; 222/372; 222/382; 222/383.1
(58) Field of Search ..... 222/78, 372, 382, 222/383.1

(56) References Cited

U.S. PATENT DOCUMENTS 1,174,674 A * 3/1916 Byer ..... 222/383.1
2,003,562 A * 6/1935 Stuart ..... 222/383.1
2,106,562 A * 1/1938 Bucci ..... 222/78
2,272,465 A * 2/1942 Horstman ..... 222/383.1
5,385,276 A * 1/1995 Yen-Tang ..... 222/78
5,697,529 A * 12/1997 Lecomte ..... 222/383.1
5,819,986 A * 10/1998 Last et al. ..... 222/383.1
5,897,027 A * 4/1999 Steiner et al. ..... 222/78
6,820,774 B2 * 11/2004 Jones ..... 222/383.1

* cited by examiner

*Primary Examiner*—Kenneth Bomberg

(57) ABSTRACT

A modeled cream bottle comprises a model having a receiving house and a receiving chamber beside the receiving house; a bottle body received in receiving chamber of the model; an press head an upper portion of which protrudes from the outlet of the receiving house, and a button being fixed to the press head. A guide tube extends into a bottom of the receiving chamber through the guiding space and another end of the guide tube extends into an inner bottom of the bottle body. Another guide tube communicates to the outlet portion of the press head. By pressing the press head, the cream in the bottle body is sucked out from the guide tubes and then flows out of the model.

2 Claims, 4 Drawing Sheets

MODELED CREAM BOTTLE

FIELD OF THE INVENTION

The present invention relates to cream bottles, and particular to a modeled cream bottle which can be used repeatedly. Moreover, a press head is installed to the lower lateral side of the model, and the pressing point of the press head is lowered. Thus, the operation is steadily. In use, the cream flowing out of the bottle will not pollute the outer surface of the bottle and the model will not be dirt and the appearance will not be destroyed.

BACKGROUND OF THE INVENTION

Referring to FIG. 1, a prior art cream bottle is illustrated. In the prior art, cream is filled in a hollow model 1. A top of the model 1 is installed with a press head 6 which can be pressed for extruding cream out of the bottle. One side of the press head 6 is installed with an outlet 61. In use, the press head 6 at the top of the model 1 is pressed so that cream flows out from the outlet 61. The press head 6 is installed at a higher portion of the model 1. Thereby, the pressing operation cannot be performed steadily. The bottle easily falls down. The protruding press head 6 causes an unbeautiful outlook. In pressing, the cream flowing out of the outlet will dirt the outlet so as to pollute the bottle. Moreover, the arrangement of the outlet causes the operation to be inconvenient since the outlet is formed as a trumpet.

SUMMARY OF THE INVENTION

Accordingly, the primary object of the present invention is to provide a modeled cream bottle comprises a model having a receiving house and a receiving chamber beside the receiving house; a bottle body received in receiving chamber of the model; an press head an upper portion of which protrudes from the outlet of the receiving house, a button being fixed to the press head. A first guide tube extending into a bottom of the receiving chamber through the guiding space and another end of the first guide tube extending into an inner bottom of the bottle body; a second guide tube communicating to the outlet portion of the press head having a section being receiving in a second guiding space extending from the receiving chamber. By pressing the press head, the cream in the bottle body is sucked out from the guide tube and then flows out of the model.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
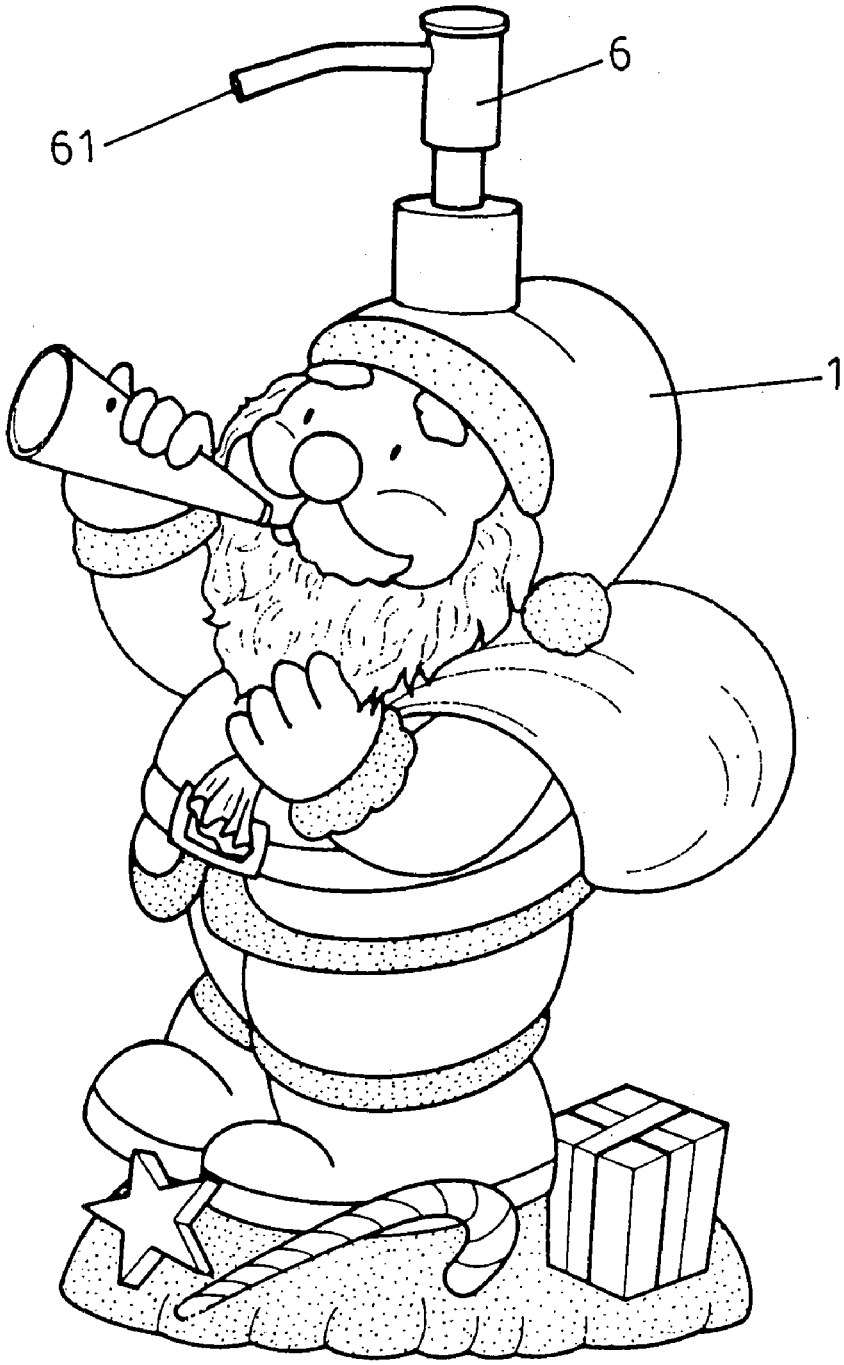
FIG. 1 is a perspective view of one prior art about the present invention.
Figure 2:
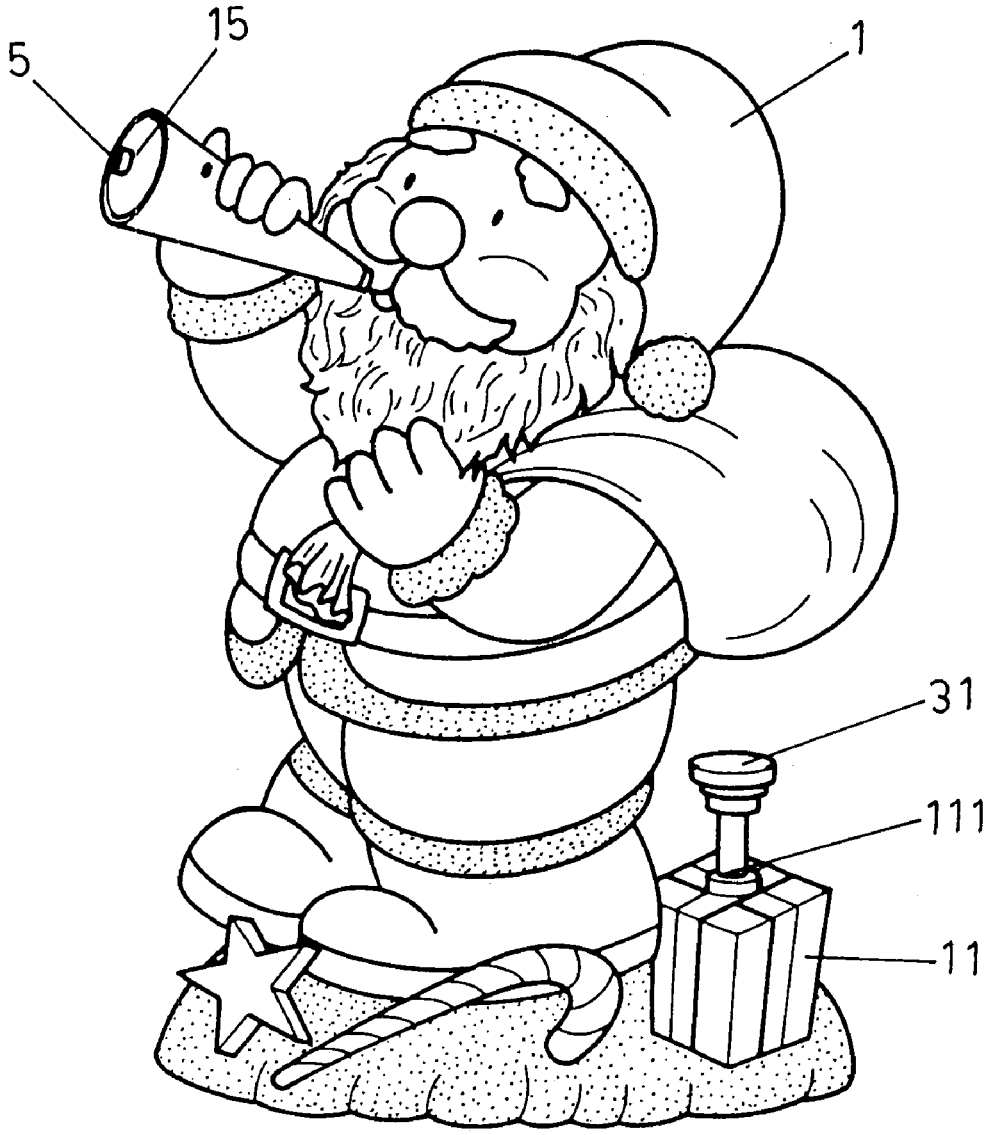
FIG. 2 is a perspective view about the present invention.
Figure 3:
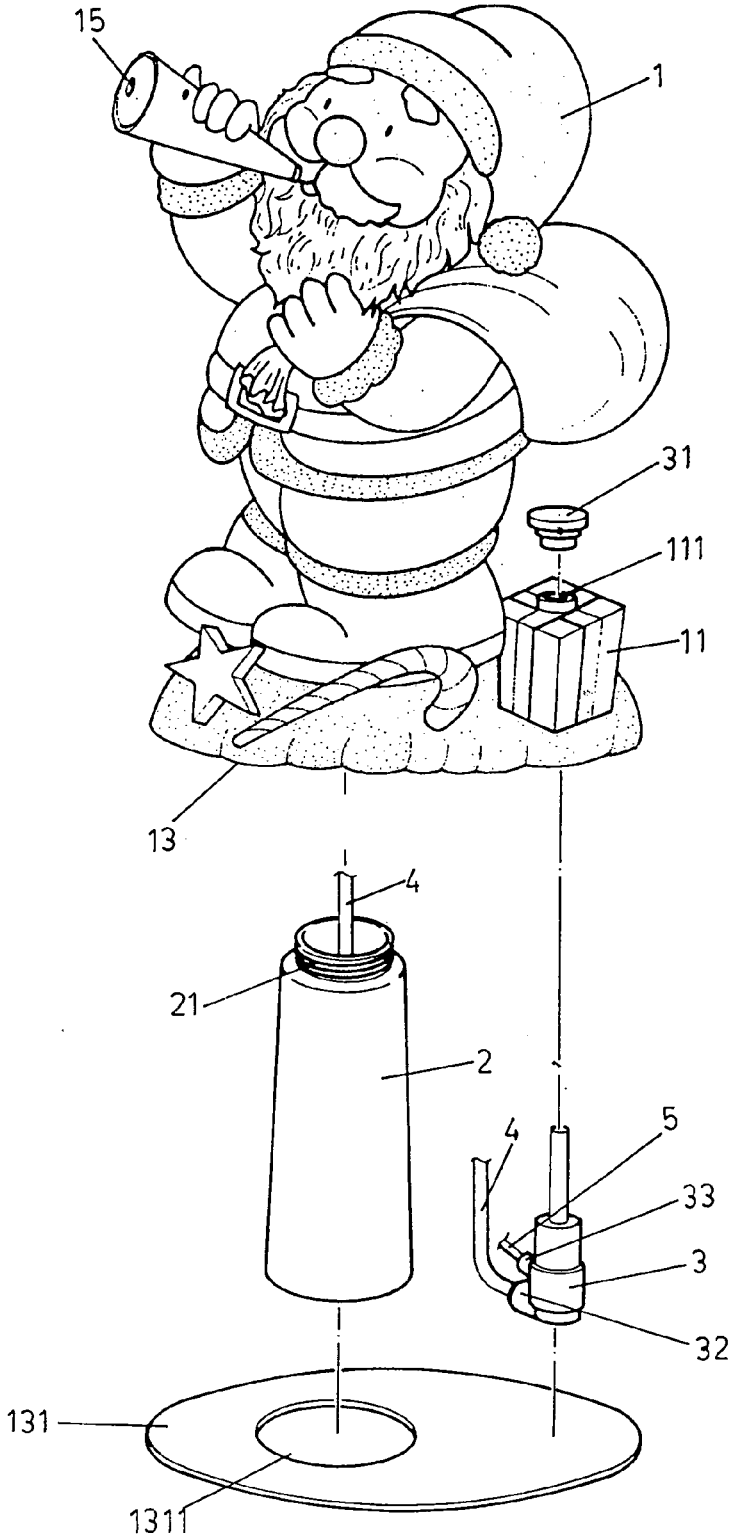
FIG. 3 is an exploded perspective view of the present invention.
Figure 4:
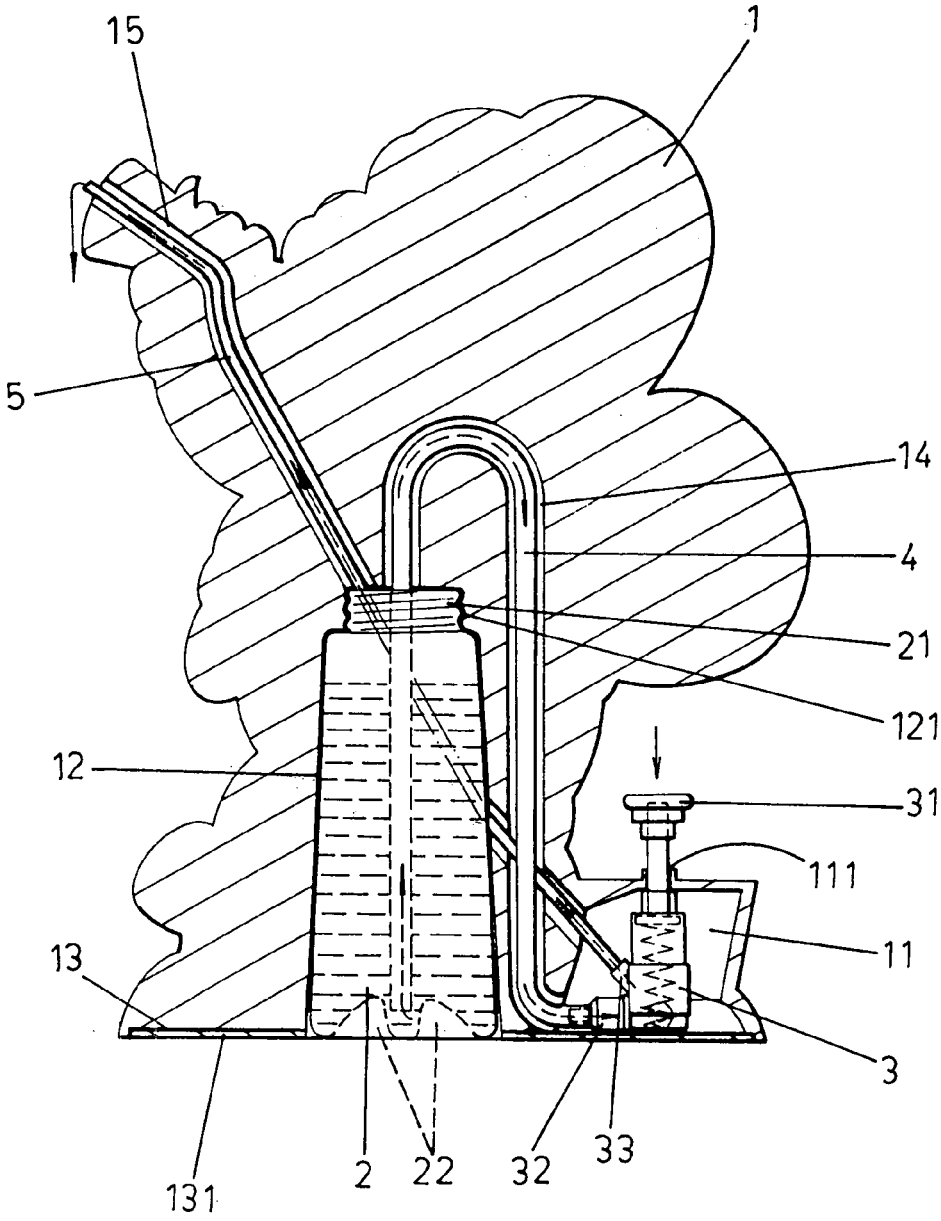
FIG. 4 is an assembled cross section view of the present invention.

Referring to FIGS. 2 and 3, the cream bottle of the present invention is illustrated. The cream bottle comprises a model 1, a bottle body 2, a press head 3, a lower cover 131. With reference to FIG. 3, the model 1 has a receiving house 11. An upper side of the receiving house 11 has an outlet 111. A center of the model 1 has a receiving chamber 12 for screwing the bottle body 2. With reference to FIG. 4, guiding spaces 14, 15 are installed at an upper side of the receiving chamber 12. The guiding spaces 14, 15 serve to provide a loop to guide the flow of cream. The guiding space 15 is communicated to the receiving chamber 12 and the guiding space 14 is communicated to the receiving house 11. The receiving house 11 has an outlet 111 at an upper side thereof. An upper portion of the press head 3 protrudes from the outlet 111 of the receiving house 11. Thereby, a button 31 can be fixed to the press head 3 so that the button 31 can be pressed conveniently for extruding cream out of the bottle body 2. One lower side of the press head 3 has an outlet portion 33 and an inlet portion 32. The inlet portion 32 is connected to the guide tube 4 and the outlet portion 33 is connected to the guide tube 5. The guide tube 4 extends into a bottom of the receiving chamber 12 through the guiding space 4 for extending into an inner bottom of the bottle body 2 so as to suck cream at the bottom of the bottle body 2 by pressing the press head 3. An upper periphery of the bottle body 2 is formed with an outer thread 21 and a bottom thereof has a recess 22. By rotating the recess 22, the outer thread 21 at the outer periphery of the bottle body 2 is screwed with the inner thread 121 of the receiving chamber 12. Furthermore, the bottle body 2 is firmly secured to an interior of the model 1. Furthermore, the guide tube 5 communicating with the outlet portion 33 of the press head 3 protrudes out of the guiding space 15. By pressing the press head 3, the cream in the bottle body 2 can be sucked out from the guide tube 4 to be guided to an inlet portion 32 of the press head 3 and then flow to the guide tube 5 of the outlet portion 33. Thereby, the cream will be extruded out of the model 1 (referring the arrow shown in FIG. 4). A bottom of the bottle body 2 has a fixing unit 13 for fixing a lower cover 131 so that the model 1 has a flat bottom. The unit 13 has a hole 1311 so that the bottle body 2 can be inserted into the model 1 from a lower side of the model 1. Thereby, it is unnecessary to remove the lower cover 131 as the cream is updated.

In the supplement of the cream, it is only necessary to release the receiving chamber 12 from the center of the model 1. Thereby, it can be used repeatedly. Thereby, it matches the requirement of environment protection. Moreover, in the present invention, the press head 3 is installed to the lower lateral side of the model 1, the pressing point of the press head 3 is lowered. The operation is steadily. The portion for outputting the cream is at an outer protrusion of the model 1. In use, the cream flowing out of the bottle will not pollute the outer surface and the model 1 will not be dirt and the appearance will not be destroyed.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A modeled cream bottle comprises a model having a receiving house and a receiving chamber beside the receiving house; an upper side of the receiving house having an outlet; a first and a second guiding spaces being installed at an upper side of the receiving chamber for guiding a flow of cream; the first guiding space being communicated to the receiving chamber and the second guiding space being communicated to the receiving house;

a bottle body received in receiving chamber of the model; an upper periphery of the bottle body being formed with an outer thread and a bottom thereof having a recess; the outer thread at the outer periphery of the bottle body being screwed with an inner thread of the receiving chamber; the bottle body being firmly secured to an interior of the model;

a press head; an upper portion of the press head protruding from the outlet of the receiving house, a button being fixed to the press head so that the button being pressed conveniently for extruding cream out of the bottle body; the press head having an outlet portion and an inlet portion;

a first guide tube being connected to the outlet portion; the first guide tube communicating to the outlet portion of the press head having a section being receiving in the first guiding space and having a section thereof protruding out of the first guiding space;

a second guiding tube being connected to the inlet portion; one end of the second guide tube extending into a bottom of the receiving chamber through the second guiding space and another end of the second guide tube extending into an inner bottom of the bottle body through the second guiding space so as to suck cream at the bottom of the bottle body by pressing the press head;

wherein by pressing the press head, the cream in the bottle body is sucked out from the guide tube to be guided to an inlet portion of the press head and then flow to the guide tube of the outlet portion; thereby, the cream will be extruded to be out of the model.

2. The modeled cream bottle as claimed in claim 1, wherein a bottom of the bottle body has a fixing unit for fixing a lower cover so that the model has a flat bottom; the unit has a hole so that the bottle body is inserted into the model from a lower side of the model.

* * * * *